US008171662B2

(12) United States Patent
Itoh et al.

(10) Patent No.: US 8,171,662 B2
(45) Date of Patent: May 8, 2012

(54) METHOD FOR PROCESSING SEPARATION AND RUPTURE PORTION OF DISPLAY LABEL, DISPLAY LABEL-ATTACHED PRODUCT, AND DISPLAY LABEL ATTACHMENT STRUCTURE

(75) Inventors: Takahiro Itoh, Osaka (JP); Katsuaki Ohnishi, Osaka (JP); Hideaki Takeuchi, Osaka (JP); Shinji Otani, Osaka (JP); Shigeru Nishiyama, Osaka (JP); Tsutomu Ashikari, Osaka (JP); Eiichi Ishikawa, Osaka (JP)

(73) Assignee: Kyocera Mita Corporation (JP)

( * ) Notice: Subject to any disclaimer, the term of this patent is extended or adjusted under 35 U.S.C. 154(b) by 322 days.

(21) Appl. No.: 12/578,740

(22) Filed: Oct. 14, 2009

(65) Prior Publication Data

US 2010/0088936 A1 Apr. 15, 2010

(30) Foreign Application Priority Data

Oct. 14, 2008 (JP) ..... 2008-265197

(51) Int. Cl.
*G09F 3/10* (2006.01)

(52) U.S. Cl. ..... 40/638; 283/67; 283/103

(58) Field of Classification Search ..... 283/67, 283/101, 103, 104; 356/71; 156/526, 268; 40/638

See application file for complete search history.

(56) References Cited

U.S. PATENT DOCUMENTS

| | | | | |
|---|---|---|---|---|
| 5,405,692 | A * | 4/1995 | Weng et al. | 428/343 |
| 2002/0026738 | A1 | 3/2002 | Shiga et al. | |
| 2005/0230961 | A1 * | 10/2005 | Walley | 283/81 |
| 2007/0224383 | A1 * | 9/2007 | Reinhart et al. | 428/43 |
| 2009/0050253 | A1 * | 2/2009 | Thomas et al. | 156/64 |
| 2009/0200790 | A1 | 8/2009 | Kanno et al. | |

FOREIGN PATENT DOCUMENTS

| | | |
|---|---|---|
| CN | 101145299 | 3/2008 |
| JP | 2001-356692 | 12/2001 |
| JP | 2008-116532 | 5/2008 |

* cited by examiner

*Primary Examiner* — Joanne Silbermann
*Assistant Examiner* — Christopher e Veraa
(74) *Attorney, Agent, or Firm* — Gerald E. Hespos; Michael J. Porco

(57) ABSTRACT

A method for processing a separation and rupture portion of a display label is a method for forming, on the display label attached to an attachment target object, the separation and rupture portion for rupturing the display label upon separation of the display label from the attachment target object. This method includes attaching, to the attachment target object, the display label having a back side on which an adhesive layer is formed, and then forming a slit serving as the separation and rupture portion on the display label.

11 Claims, 3 Drawing Sheets

METHOD FOR PROCESSING SEPARATION AND RUPTURE PORTION OF DISPLAY LABEL, DISPLAY LABEL-ATTACHED PRODUCT, AND DISPLAY LABEL ATTACHMENT STRUCTURE

BACKGROUND OF THE INVENTION

1. Field of the Invention

The present invention relates to a method for processing a separation and rupture portion of a display label, a display label-attached product, and a display label attachment structure.

2. Description of the Related Art

In an image forming apparatus such as a printer or a copying machine, a developing unit is equipped with a toner container for supplying toner. In the image forming apparatus, the toner in the toner container is consumed by an image forming operation. When the toner in the toner container is exhausted, the toner container is exchanged with a new container filled with toner (a toner container). By this exchange of the toner containers, the image forming apparatus can continuously perform the image forming operation.

In the exchange of the toner containers, there is typically used a genuine toner container provided from a manufacturer of the image forming apparatus. However, an inferior counterfeit manufactured by someone other than the manufacturer of the image forming apparatus (a so-called pirated product) is also available on the market. Such a counterfeit is used occasionally.

Toner in the counterfeit manufactured by someone other than the manufacturer of the image forming apparatus is different in property from the toner in the genuine product, and is not intended for use in a main body of the image forming apparatus. Consequently, such toner causes a problem of degradation in image quality, and the like. In addition to the problem of degradation in image quality, further, the use of the inferior counterfeit results in a malfunction of the main body of the image forming apparatus, and may bring about a worst state in which the apparatus main body is rendered inoperable.

In order to deal with this problem, a display label is attached to the genuine product to allow a user to distinguish the genuine product from the counterfeit. In some instances, however, such a display label is separated from the used genuine toner container from which the toner is exhausted, and the counterfeit having the display label attached thereto is distributed in the market.

In order to prevent reuse of the display label which is separated from the genuine product and then is attached to the counterfeit, conventionally, there has been employed a method for forming a slit on a part of the display label to rupture the display label when being separated.

Known methods include, for example, a technique which adopts an anti-tampering label including a label base member on which a slit is formed partially in such a shape that the label base member is ruptured when the attached label is separated. In this method, a width of the slit is widened to prevent adhesive layers separated by the slit from being bonded by a secular change. This configuration enhances an effect of rupturing the label when being separated.

Another technique which adopts a display label with a back side having applied thereto an adhesive is also known. Herein, the display label includes a brittle portion in which a plurality of slits are formed at a position spaced inwardly apart from an outer peripheral edge of the display label. Moreover, the plurality of slits extend to intersect each other. In this method, when a separation force acts on the display label attached to an attachment target object, the brittle portion concentrically receives a rupture force according to an attachment force of the display label. Thus, this configuration enhances an effect of rupturing the display label when being separated.

However, the conventional display label having partially formed thereon the slit can be separated without being ruptured by change of a separation force, a separation direction, a separation sequence at a place where the display label is separated, and the like. Further, the display label having the slit can also be separated without being ruptured in such a manner that heat is applied to the display label to reduce the separation force. Alternatively, the display label having the slit can also be separated without being ruptured by use of a sharp cutter. The display label is separated using such a method for separating the display label without rupturing the display label, and can be reused in a state in which the display label is attached to a counterfeit.

As described above, the foregoing conventional methods employ the configuration that enhances the effect of rupturing the display label when being separated, but have a problem that the display label can be separated using the method for separating the display label without rupturing the display label. Consequently, it is impossible to prevent the reuse of the display label with reliability.

SUMMARY OF THE INVENTION

It is an object of the present invention to provide a method for processing a separation and rupture portion of a display label, the method being capable of rupturing the display label attached to an attachment target object with reliability upon separation of the display label from the attachment target object and being capable of preventing reuse of the display label, a display label attachment structure, and a display label-attached product.

In order to accomplish this objective, according to one aspect of the present invention, a method for processing a separation and rupture portion of a display label is a method for forming, on the display label attached to an attachment target object, the separation and rupture portion for rupturing the display label upon separation of the display label from the attachment target object. This method includes attaching, to the attachment target object, the display label having a back side on which an adhesive layer is formed, and then forming a slit serving as the separation and rupture portion on the display label.

Any other objectives of the present invention and specific advantages obtained by the present invention will become more apparent from the following detailed description of preferred embodiments.

DETAILED DESCRIPTION OF THE PREFERRED EMBODIMENTS

With reference to the drawings, hereinafter, detailed description will be given of a best embodiment of the present invention. In the respective drawings, members designated by an identical reference symbol are equal in configuration to one another, and repetitive description thereof will be not given as appropriate. In the respective drawings, moreover, members irrelevant to the description are not shown as appropriate.

With reference to FIGS. 1 to 4, hereinafter, this embodiment describes an example that a display label is attached to a toner container which is a replacement component (a consumable supply) for use in an image forming apparatus such as a printer or a copying machine. A toner container 30 is filled with toner to supply the toner to a developing unit in an image forming apparatus.

Figure 1:
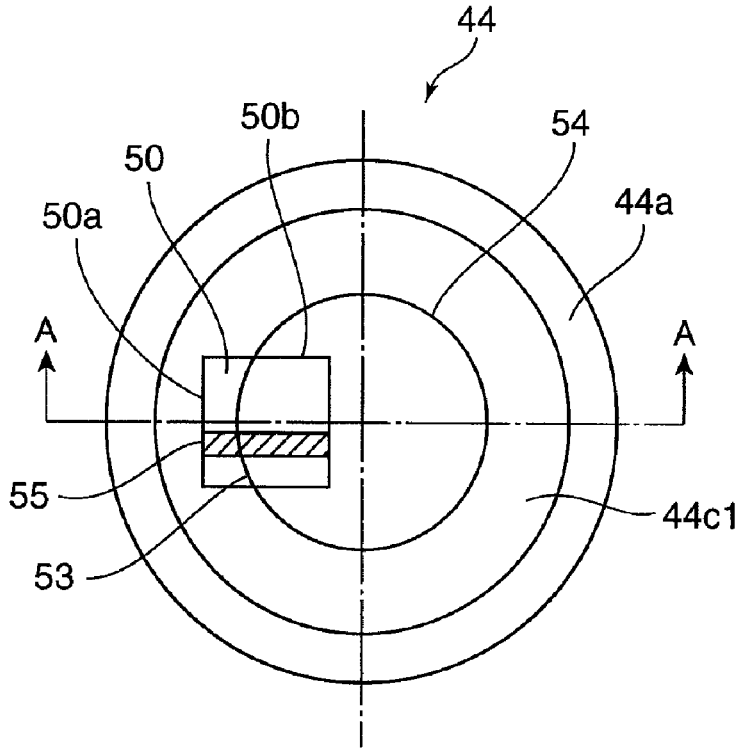
FIG. 1 shows a plan view of a cap of a toner container according to one embodiment of the present invention.
Figure 2:
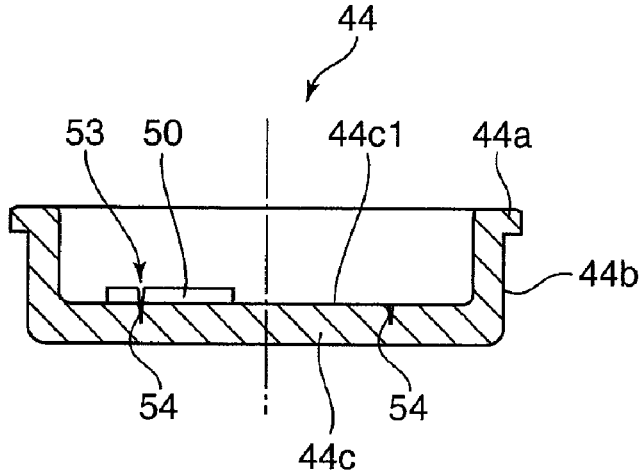
FIG. 2 shows a sectional view of the cap shown in FIG. 1, the sectional view being taken along line A-A in FIG. 1.
Figure 3:
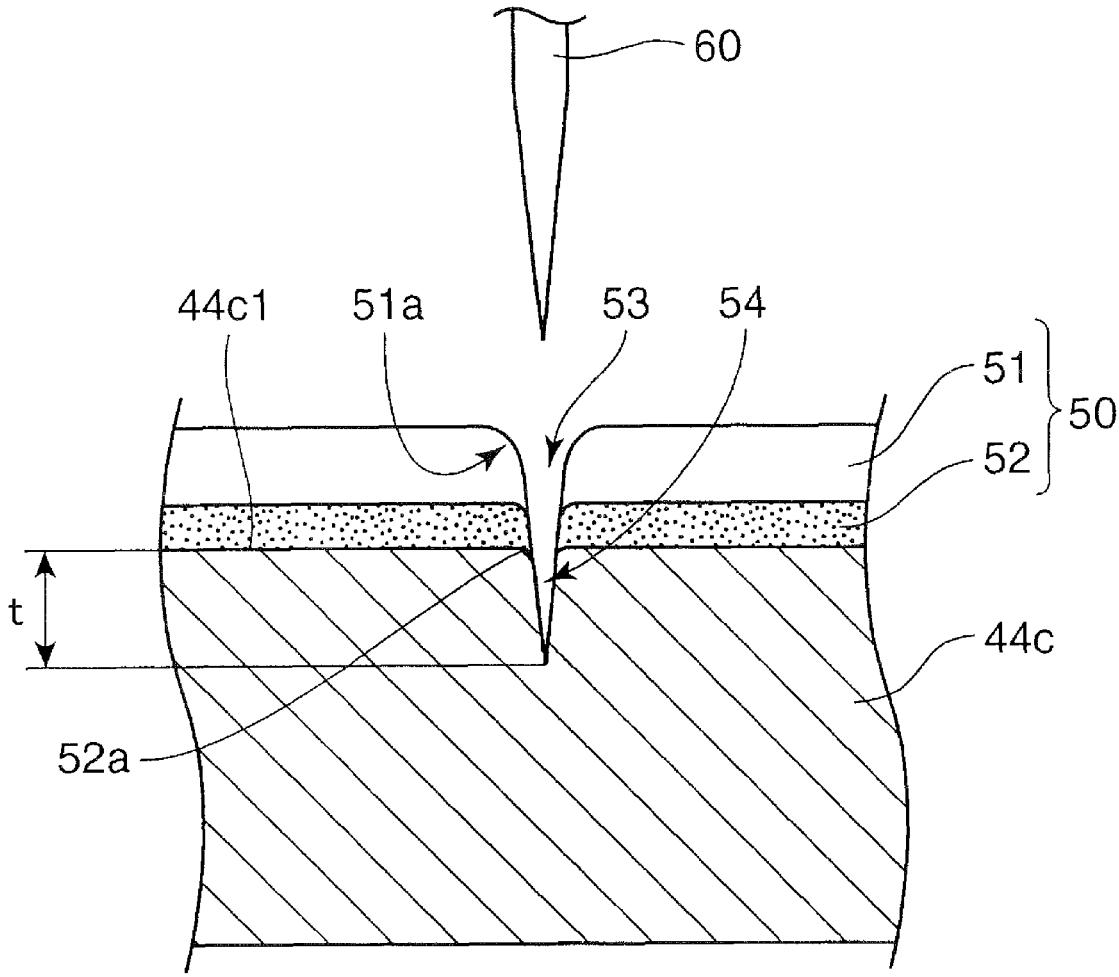
FIG. 3 shows a sectional view of a principal part of the cap for describing a method for processing a separation and rupture portion of a display label according to the embodiment of the present invention.
Figure 4:
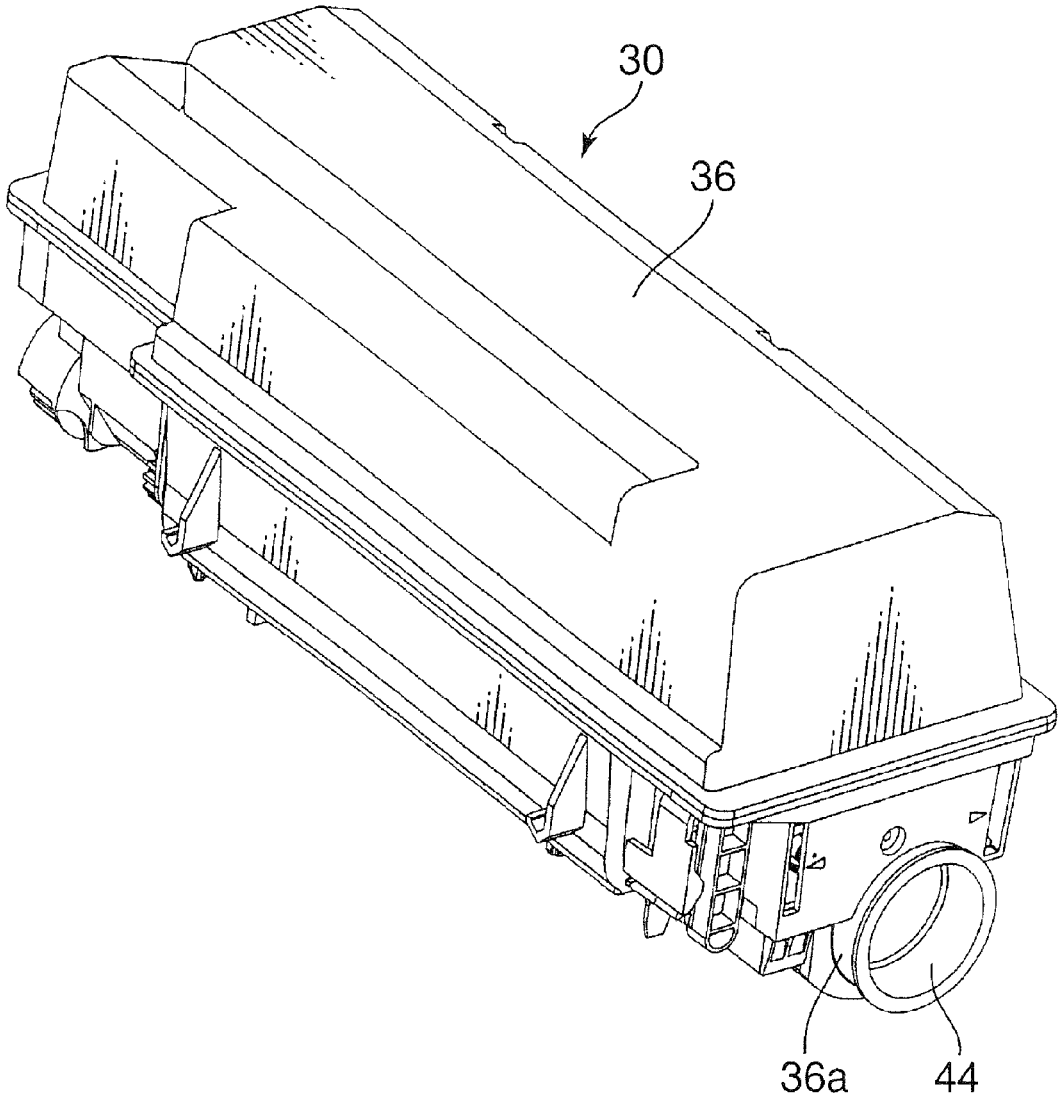
FIG. 4 shows a perspective view of the toner container according to the embodiment of the present invention.

FIG. 1 shows a plan view of a cap 44 of the toner container 30 according to this embodiment. FIG. 2 shows a sectional view of the cap 44 shown in FIG. 1, the sectional view being taken along line A-A in FIG. 1. FIG. 3 shows a sectional view of a principal part for describing a method for processing a separation and rupture portion of a display label 50 attached to the cap 44. FIG. 4 shows a perspective view of the toner container 30.

As shown in FIG. 4, the toner container 30 includes a container main body 36 in addition to the cap 44. The container main body 36 is provided with an open filling port 36*a* through which the toner is filled into the toner container 30. The cap 44 is fitted into the filling port 36*a* in a removable manner. In the container main body 36, the filling port 36*a* has a flange portion formed at a periphery thereof. Moreover, the cap 44 also has a flange portion formed at a periphery thereof. In the state in which the cap 44 is fitted into the filling port 36*a*, the flange portion of the filling port 36*a* tightly comes into contact with the flange portion of the cap 44. Then, both the flange portions are ultrasonically bonded together, so that the toner container 30 is totally enclosed to prevent the toner from leaking therefrom.

As shown in FIGS. 1 and 2, in addition to the flange portion 44*a* that tightly comes into contact with the flange portion of the filling port 36*a*, the cap 44 further includes a cylinder-shaped insertion portion 44*b* that corresponds to a side surface of the cap 44 and is inserted into the filling port 36*a*, and a disc-shaped closure portion 44*c* that corresponds to a bottom of the cap 44 and closes the filling port 36*a*. As described above, the flange portion 44*a* of the cap 44 fitted into the filling port 36*a* is ultrasonically welded to the flange portion of the filling port 36*a*. The display label 50 for authentication is attached to an outer surface 44*c*1 of the closure portion 44*c* of the cap 44.

As shown in FIG. 3, the display label 50 has a laminate structure of a display label base 51 and an adhesive layer 52. The display label base 51 is a plastic film, and examples of a material therefor may include polystyrene, polypropylene, polyethylene terephthalate, polymethyl methacrylate, polycarbonate, and the like. As shown in FIG. 1, moreover, a counterfeit preventive hologram 55 is formed on at least part of the display label base 51. The hologram 55 has hologram information recorded therein by a typical method using a laser beam or the like, and can be visually recognized under specific conditions. In addition to the hologram 55, required information can be recorded on a display surface (a top surface) of the display label base 51. The display label 50 is attached to the cap 44 (an attachment target object) by the adhesive layer 52 formed under the display label base 51.

The display label 50 attached to the cap 44 has a slit (a separation and rupture portion) 53 that allows rupture of the display label 50 with reliability upon separation of the display label 50 to disable the display label 50 from being reused. Hereinafter, detailed description will be given of a method for processing the separation and rupture portion of the display label 50.

Prior to attachment to the cap 44, the display label 50 has no slit 53 as the separation and rupture portion. Accordingly, the display label 50 can be readily attached to the cap 44 as compared with a conventional display label having a separation and rupture portion formed thereon prior to the attachment.

This embodiment employs a characteristic method of attaching the display label 50 having no separation and rupture portion to the cap 44 and then forming the slit 53 on the display label 50 by press working using a Thomson die.

As shown in FIG. 3, more specifically, the display label 50 is attached to the outer surface 44*c*1 of the closure portion 44*c* of the cap 44. Then, a cutter blade (a Thomson blade) 60 of the Thomson die is pressed against the display surface of the display label base 51. This cutter blade 60 cuts the display label base 51 and the adhesive layer 52 to form the slit 53. Herein, the display label base 51 and the adhesive layer 52 are pressed by the cutter blade 60 toward the cap 44 until the cutter blade 60 cuts the display label base 51. In a periphery of a portion where the slit 53 is formed, accordingly, the portion corresponding to the adhesive layers 52 divided by the slit 53 is strongly pressed against the attachment target object (the outer surface 44*c*1 of the cap closure portion 44*c*) as compared with the remaining portion of the adhesive layer 52.

As described above, the slit 53 is formed on the display label 50 with the cutter blade 60 pressed against the display label 50, so that a local pressing force generates at the periphery of the portion where the slit 53 is formed. In the display label 50, thus, an adhesion force at the periphery of the portion where the slit 53 is formed (a bonding force to the cap 44) increases as compared with the remaining portion. This configuration allows rupture of the display label 50 with reliability upon separation of the display label 50.

In the pressing and shearing process using the cutter blade 60, desirably, the cutter blade 60 is pressed against the display label 50 until a cutting edge of the cutter blade 60 reaches inside the cap 44 to form a groove 54 on the outer surface 44*c*1 of the closure portion 44*c* of the cap 44. As described above, the cutting edge of the cutter blade 60 penetrates through the display label 50 and reaches inside the cap 44, so that a sag generates at a top surface of the display label 50 cut by the pressing and shearing process whereas a burr generates at a bottom surface of the display label 50. More specifically, the sag, the sheared portion, the ruptured portion and the burr generate sequentially from the pressing start side of the pressing and shearing process (the press cut working) using the Thomson die (the press die). This burr is also referred to as a fin and indicates a downwardly protruding state. By the pressing and shearing process described above, the sag 51*a* generates at the top surface of the display label base 51 whereas the burr 52*a* generates at the adhesive of the adhesive layer 52. By virtue of the generation of the sag 51*a* and the burr 52*a*, the display label 50 is attached to the cap 44 with a stronger adhesion force.

Moreover, the cutter blade 60 is cut into the closure portion 44*c* of the cap 44, i.e., the attachment target object (see a depth t in FIG. 3) to form the groove 54 on the outer surface 44*c*1 of the closure portion 44*c*. The groove 54 prevents movement of the adhesive of the adhesive layer 52. More specifically, the adhesive layer 52 is divided by the slit 53 and the groove 54 following the slit 53, and the groove 54 inhibits physical movement of the adhesives of the divided adhesive layers 52 between which the slit 53 is formed. With this configuration, it is possible to prevent the adhesives of the adhesive layers 52 divided by the slit 53 from being bonded by a secular change, to maintain a separation and rupture property for a long term, and to enhance an effect of rupturing the display label when being separated. Herein, the depth t of the groove 54 formed on the closure portion 44*c* of the cap 44 can be set optionally within a range that the cap 44 is not degraded in strength.

Desirably, the cap 44, i.e., the attachment target object is made of resin (synthetic resin or natural resin). When the attachment target object is made of resin which is lower in hardness than the cutter blade 60, the cutter blade 60 of the Thomson die can be prolonged in service life.

As shown in FIG. 1, further, the slit 53 is continuously formed across the display label 50 (i.e., from a predetermined position to a different position on an outer peripheral edge of the display label 50), so that the display label 50 is divided by the slit 53. More specifically, by the formation of the slit 53, the display label 50 is divided into a first fragment 50*a* and a second fragment 50*b*. Thus, the display label 50 is ruptured with reliability when being separated. As described above, the display label 50 is totally divided by the slit 53 in the state in which the display label 50 is attached to the cap 44, i.e., the attachment target object. As a result, in order to separate and reuse the display label 50, the first fragment 50*a* and the second fragment 50*b* must be brought back into alignment with each other with inconvenience and difficulty. Even when the display label 50 is reused, the fact of reuse can be readily detected from misalignment between the first fragment 50*a* and the second fragment 50*b*, and the like. This configuration allows a user to identify the reuse of the display label 50 to prevent the user from misrecognizing a counterfeit as a genuine product. With this configuration, thus, it is possible to maintain and control performance of the image forming apparatus and to stably use the image forming apparatus for a long term.

Further, the display label 50 has a hologram formation region where the hologram 55 is formed, and this hologram formation region is located on at least part of the label display surface. In the display label 50, desirably, the hologram 55 is provided on the portion where the slit 53 is formed. In other words, the slit 53 is continuously formed across the hologram formation region of the display label 50 to divide the hologram formation region into two. Thus, one of the divided holograms 55 is on the first fragment 50*a* whereas the remaining hologram 55 is on the second fragment 50*b*. In this case, even when the display label 50 separated from the cap 44 is reused in such a manner that the first fragment 50*a* and the second fragment 50*b* are brought back into alignment with each other, the divided holograms 55 can not brought back into alignment with each other with ease. Herein, since the hologram information can be visually recognized only under the specific conditions, a person who intends to reuse the display label 50 fails to read the information under normal conditions. Even when the person brings the first fragment 50*a* and the second fragment 50*b* back into alignment with each other without visually recognizing the hologram information under the normal conditions, a displacement of the hologram information occurs without fail. This displacement of the hologram information notifies the user of the reuse of the display label 50.

As shown in FIG. 1, moreover, the display label 50 is smaller in area than the outer surface 44*c*1 of the closure portion 44*c* of the cap 44, i.e., the attachment target object. The groove 54 formed simultaneously with the slit 53 on the cap 44 is also formed on the portion except the portion where the display label 50 is attached in the cap 44. Thus, the groove 54 following the slit 53 can be visually recognized on the cap 44. By the pressing of the cutter blade 60, the slit 53 on the display label 50 and the groove 54 on the cap 44 are formed simultaneously, and the groove 54 following the slit 53 is formed on the region where the display label 50 is not attached in the cap 44. With this configuration, the user determines whether the groove 54 is coincident with the slit 53 of the display label 50 to distinguish a genuine product from a counterfeit.

Specifically, it is assumed herein that the first fragment 50*a* and the second fragment 50*b* are attached to a cap of a counterfeit for the purpose of the reuse of the display label 50. In such a case, if the groove 54 described above is not formed on the cap of the counterfeit, the user can readily identify the counterfeit. Moreover, even when such a groove 54 is formed on the cap of the counterfeit in the state in which the first fragment 50*a* and the second fragment 50*b* are attached to the cap, a position where the groove 54 is formed can not be fixed with ease because the groove 54 must be coincident with the slit 53 with reliability. Accordingly, it is impossible to form the groove 54 which is coincident with the slit 53 on the cap of the counterfeit without much time and effort. Further, it requires much time and effort to form the groove 54 on the cap of the counterfeit and then to attach the first fragment 50*a* and the second fragment 50*b* to the cap in a state of the groove 54 coincident with the slit 53 with reliability, which is not realistic. As described above, it is substantially impossible to separate the display label 50 divided into the first fragment 50*a* and the second fragment 50*b* from the genuine product and then to attach the first fragment 50*a* and the second fragment 50*b* to the cap of the counterfeit for the purpose of the reuse of the display label 50.

As shown in FIG. 1, further, the slit 53 and the groove 54 are curved. This curve makes it more difficult to bring the first fragment 50*a* and the second fragment 50*b* back into alignment with each other, and therefore further enhances the effect of preventing the reuse of the display label 50.

In this embodiment, the portion where the display label 50 is attached in the cap 44 is the outer surface 44*c*1 of the closure portion 44*c* corresponding to the concave bottom of the cap 44. With this configuration, the person who intends to reuse the display label 50 can not attach the display label 50 to the recessed portion with ease, and this operation promotes the difficulty of bringing the first fragment 50*a* and the second fragment 50*b* back into alignment with each other. With this configuration, accordingly, it is possible to further enhance the effect of preventing the reuse of the display label 50.

In this embodiment, further, the display label 50 for authentication is attached to the cap 44 supersonically welded to the container main body 36 of the toner container 30. This configuration allows recycle of the container main body 36; however, there is a possibility that the container main body 36 is filled with inferior toner and then is unfairly reused as a false genuine product. In such a case, the display label 50 attached to the cap 44 allows distinction between a genuine product and a counterfeit to prevent the counterfeit from being distributed illegally.

The activity of filling the empty container main body 36 with toner again to recycle the toner container 30 is recommendable from a point of view of environmental protection. However, if the display label 50 is attached to the portion other than the cap 44 (i.e., the container main body 36) in the toner container 30, the container main body 36 can be reused as it is without separation of the display label 50. Consequently, this case fails to prevent a counterfeit from being distributed illegally as a false genuine product. On the other hand, in the case where the display label 50 is attached to the cap 44, a new cap must be supersonically welded to the container main body 36 for the purpose of the recycle and distribution of the container main body 36 filled with toner again. Therefore, even when the display label 50 separated once for reuse is attached to the new cap, the counterfeit can be detected as described above. Accordingly, it is possible to prevent a counterfeit from being illegally distributed as a false genuine product.

As described above, by use of the counterfeit toner container filled with inferior toner, the image forming apparatus has a problem of degradation in image quality. Further, this use results in a malfunction of the main body of the image forming apparatus, so that the main body can not be operated until its durable service life. As a result, a large number of components and units must be exchanged because of the malfunction in the main body of the image forming apparatus, and wasteful energy is consumed for the exchanges of the components, and the like. These disadvantages may lead to collapse of credit of a manufacturer of the image forming apparatus. This embodiment solves the problem leading to the enormous disadvantages in such a manner that the display label 50 is attached to the cap 44 and then the separation and rupture portion is formed on the display label 50 as described above.

In order to reuse the empty container main body 36 by filling the container main body 36 with genuine toner and to distribute the container main body 36 as a genuine product, only the genuine cap 44 (i.e., the cap 44 to which the display label 50 having the separation and rupture portion is attached) is exchanged with new one.

In this embodiment, the display label 50 is attached to the toner container 30 for use in an image forming apparatus such as a printer or a copying machine; however, the present invention is not limited to this example. Alternatively, the display label 50 may be attached to a unit such as a developing unit integrated with a toner container. Further, the display label 50 may be attached to another consumable supply to be used in an image forming apparatus in an exchangeable manner. The present invention is applicable to not only consumable supplies of the image forming apparatus, but also all display label-attached products.

In this embodiment, moreover, the slit 53 is continuously formed across the display label 50 (i.e., from the predetermined position to the different position on the outer peripheral edge of the display label 50) to divide the display label 50; however, the present invention is not limited to this example. Alternatively, there is no necessity that the slit 53 is continuously formed across the display label 50. In other words, there may be present a portion where the slit 53 is interrupted (i.e., a portion where the slit 53 is not formed). The portion where the slit 53 is interrupted corresponds to a connecting portion between the first fragment 50*a* and the second fragment 50*b*. Desirably, this connecting portion is made brittle in such a manner that an area thereof is made sufficiently small (i.e., the area is made small as much as possible). The brittle connecting portion which is small in area ensures reliable separation and rupture at the time when the display label 50 is separated from the attachment target object. This embodiment employs the method of attaching the display label 50 to the attachment target object and then forming the slit 53 on the display label 50, leading to considerable enhancement of a degree of freedom concerning the process for forming the slit 53. Thus, even when the brittle connecting portion is formed as described above, the area thereof can be set optionally.

In contrast to this, a conventional display label has a slit formed prior to attachment to an attachment target object. For this reason, this conventional technique incurs such a restriction that an area of a brittle connecting portion can not be made small so much in order to prevent the display label having the slit from being divided at the time when the display label is separated from a release sheet and then is attached to the attachment target object. According to this embodiment, on the other hand, the display label 50 is attached to the attachment target object and then the slit 53 is formed on the display label 50. Therefore, this embodiment does not incur the restriction described above and has such an excellent advantage that the slit 53 can be formed on the display label 50 in an optional form.

In this embodiment, further, the slit 53 divides the display label 50 into the first fragment 50*a* and the second fragment 50*b*; however, the present invention is not limited to this example. Alternatively, the slit 53 may divide the display label 50 into at least three fragments. This embodiment employs the method of attaching the display label 50 to the attachment target object and then forming the slit 53 on the display label 50, leading to considerable enhancement of a degree of freedom concerning the process for forming the slit 53. As a result, the number of fragments can be readily increased by formation of a large number of slits 53 on the display label 50. As the number of fragments in the display label 50 becomes larger by the formation of the slits 53, the difficulty of the reuse of the display label 50 increases.

The method for processing the separation and rupture portion of the display label, the display label attachment structure, and the display label-attached product according to the present invention are applicable to not only consumable supplies of an image forming apparatus, but also all products to which a display label for authentication is attached.

As described above, according to one aspect of the present invention, a method for processing a separation and rupture portion of a display label is a method for forming, on the display label attached to an attachment target object, the separation and rupture portion for rupturing the display label upon separation of the display label from the attachment target object. This method includes attaching, to the attachment target object, the display label having a back side on which an adhesive layer is formed, and then forming a slit serving as the separation and rupture portion on the display label.

With this configuration, the display label is attached to the attachment target object, and then the slit is formed on the display label. Therefore, the configuration considerably enhances a degree of freedom concerning the process for forming the slit. A conventional display label has a slit formed prior to attachment to an attachment target object, and consequently incurs such a restriction that a size of a brittle portion other than the slit is not made small so much in order to prevent the display label having the slit from being ruptured at the time when the display label is separated from a release sheet and then is attached to the attachment target object. In contrast to this, according to the configuration described above, the slit for separation and rupture is formed on the display label after the display label is attached to the attachment target object. Therefore, the configuration incurs no restriction upon formation of the slit, unlike the conventional technique. With the configuration, thus, it is possible to freely form the slit. For example, the brittle portion can be made small as much as possible. As a result, the display label having the separation and rupture portion (the slit) formed by the method configured as described above is ruptured with reliability when being separated from the attachment target object. Accordingly, the configuration makes it considerably difficult to reuse the display label and to prevent the reuse with reliability.

In the configuration described above, preferably, the display label is divided by the slit in such a manner that the slit is continuously formed from a predetermined position to a different position on an outer peripheral edge of the display label.

With this configuration, in the state in which the display label is attached to the attachment target object, the slit is formed from the predetermined position to the different position on the outer peripheral edge of the display label, and the display label is totally divided by the slit. The configuration can be realized because of an enhanced degree of freedom concerning the process for forming the slit using the method of attaching the display label to the attachment target object and then forming the slit on the display label. Thus, it is assumed herein that a person who intends to reuse the display label separates the display label from the attachment target object. In such a case, it is indispensable for the person to bring the divided display labels back into alignment with each other with inconvenience and difficulty. Moreover, even when the display label is reused, the fact of reuse can be readily detected from misalignment between the divided display labels, and the like. With the configuration, accordingly, it is possible to further enhance an effect of preventing the reuse of the display label.

In the configuration described above, preferably, the slit is formed on the display label in such a manner that a cutter blade is pressed against the display label.

With this configuration, the slit is formed on the display label while the cutter blade is pressed against the display label, so that a local pressing force generates at a periphery of a portion where the slit is formed. In the display label, thus, an adhesion force at the periphery of the portion where the slit is formed (a bonding force to the attachment target object) increases as compared with the remaining portion. As described above, the configuration increases the adhesion force at the periphery of the portion where the slit is formed in the display label to allow reliable rupture of the display label when being separated.

In the configuration described above, preferably, when the cutter blade is pressed against the display label, a cutting edge of the cutter blade reaches inside the attachment target object to form a groove on the attachment target object.

With this configuration, the cutter blade reaches inside the attachment target object to form the groove on the attachment target object, so that the groove prevents the adhesive of the adhesive layer from moving in the display label. More specifically, the adhesive layer of the display label is divided by the slit and the groove following the slit, and the groove inhibits physical movement of both the adhesive layers divided by the slit. With the configuration, thus, it is possible to prevent the adhesive layers divided by the slit from being bonded by a secular change, to maintain a separation and rupture property for a long term, and to enhance the effect of rupturing the display label when being separated. Moreover, the groove formed by the cutter blade is left on the attachment target object. Therefore, a person who intends to reuse the display label must align the groove with the slit in addition to the alignment of the divided display labels. With the configuration, accordingly, it is possible to further facilitate the determination whether the display label is reused.

In the configuration described above, preferably, the attachment target object is made of resin.

With this configuration, the attachment target object is made of resin which is readily subjected to processing and is satisfactorily lower in hardness than the cutter blade. Accordingly, it is possible to prolong a service life of the cutter blade.

Moreover, according to another aspect of the present invention, a display label-attached product includes the attachment target object, and the display label having the slit formed by the method for processing the separation and rupture portion of the display label.

This configuration allows realization of a display label-attached product which is considerably excellent in effect of preventing reuse of the display label and facilitates determination whether the display label is reused. Accordingly, the configuration allows a user to readily identify that the display label is reused, to prevent the user from misrecognizing a counterfeit as a genuine product.

In the display label-attached product, preferably, the attachment target object is a consumable supply for use in an image forming apparatus in an exchangeable manner.

With this configuration, it is possible to prevent a user from misrecognizing a counterfeit as a genuine product with regard to consumable supplies of the image forming apparatus, and therefore to maintain and control performance of the image forming apparatus. Hence, it is possible to stably use the image forming apparatus for a long term.

Further, according to still another aspect of the present invention, a display label attachment structure includes a display label having a back side on which an adhesive layer is formed, and an attachment target object to which the display label is attached. Herein, the display label has a slit serving as a separation and rupture portion for rupturing the display label upon separation of the display label from the attachment target object, and the display label is divided by the slit in such a manner that the slit is continuously formed from a predetermined position to a different position on an outer peripheral edge of the display label.

With this configuration, in the state in which the display label is attached to the attachment target object, the slit is formed from the predetermined position to the different position on the outer peripheral edge of the display label, and the display label is totally divided by the slit. Thus, it is assumed herein that a person who intends to reuse the display label separates the display label from the attachment target object. In such a case, it is indispensable for the person to bring the divided display labels back into alignment with each other with inconvenience and difficulty. Moreover, even when the display label is reused, the fact of reuse can be readily detected from misalignment between the divided display labels, and the like. With the configuration, accordingly, it is possible to prevent the reuse of the display label.

In the display label attachment structure, preferably, the attachment target object has a groove corresponding to the slit, the groove being formed at a position where the slit is formed in a region where the display label is attached.

With this configuration, the groove corresponding to the slit is formed on the attachment target object to prevent the adhesive of the adhesive layer from moving in the display label. More specifically, the adhesive layer of the display label is divided by the slit and the groove following the slit, and the groove inhibits physical movement of both the adhesive layers divided by the slit. With the configuration, thus, it is possible to prevent the adhesive layers divided by the slit from being bonded by a secular change, to maintain a separation and rupture property for a long term, and to enhance the effect of rupturing the display label when being separated.

In the display label attachment structure, preferably, the attachment target object has a groove following the slit, the groove being formed in a region where the display label is not attached.

With this configuration, the groove is also formed on the region where the display label is not attached in the attachment target object, and the user can visually recognize the groove following the slit, on the attachment target object.

Thus, the user can promptly determine, as a counterfeit, an attachment target object on which such a groove is not formed. Further, if the groove is not coincident with the slit on the display label, the user can determine that the display label is reused. As described above, a person who intends to reuse the display label separates the divided display labels from the attachment target object and then aligns the groove with the slit in addition to the alignment of the divided display labels, with increased inconvenience and difficulty. With the configuration, accordingly, it is possible to further enhance the effect of preventing the reuse of the display label.

In the display label attachment structure, preferably, the display label has a hologram formation region where a hologram is formed, the hologram formation region being located on at least part of a label display surface, and the hologram formation region is divided by the slit.

With this configuration, it is assumed herein that a person who intends to reuse the display label separates the divided display labels from the attachment target object. In such a case, the person can not bring the divided holograms back into alignment with each other with ease. More specifically, information of this hologram can be visually recognized under specific conditions, and therefore can not be read under normal conditions. For this reason, even when the person brings the divided display labels back into alignment with each other without visually recognizing the information of the hologram under the normal conditions, there arises misalignment on the information of the hologram. As a result, the user can determine that the display label is reused, from this misalignment of the hologram. With the configuration, accordingly, it is possible to further enhance the effect of preventing the reuse of the display label.

This application is based on Japanese patent application serial No. 2008-265197 filed in Japan Patent Office on Oct. 14, 2008, the contents of which are hereby incorporated by reference.

The specific embodiments and examples in the detailed description of the invention are merely intended to clarify the technical contents of the present invention. Therefore, it is understood that the present invention should not be interpreted narrowly within only these embodiments and examples, and various modifications and variations can be devised within the scope of the spirit of the present invention and the following claims.

What is claimed is:

1. A method for processing a separation and rupture portion of a display label attached to an attachment target object for rupturing the display label upon separation of the display label from the attachment target object, the method comprising:

attaching, to the attachment target object, the display label having a back side on which an adhesive layer is formed, pressing a cutting blade against the display label for forming a slit serving as the separation and rupture portion on the display label, and continuing pressing the cutter blade against the display label until a cutting edge of the cutter blade reaches inside the attachment target object to form a groove on the attachment target object.

2. The method for processing the separation and rupture portion of the display label according to claim 1, wherein the display label is divided by the slit in such a manner that the slit is continuously formed from a predetermined position to a different position on an outer peripheral edge of the display label.

3. A display label-attached product comprising:

the attachment target object; and the display label having the slit formed by the method for processing the separation and rupture portion of the display label according to claim 2.

4. The display label-attached product according to claim 3, wherein the attachment target object is a consumable supply for use in an image forming apparatus in an exchangeable manner.

5. The method for processing the separation and rupture portion of the display label according to claim 1, wherein the attachment target object is made of resin.

6. The method for processing the separation and rupture portion of the display label according to claim 1, wherein the step of continuing pressing the cutter blade to form the groove on the attachment target object is carried out for urging a portion of the adhesive layer into the groove.

7. A display label attachment structure comprising a display label having a back side on which an adhesive layer is formed, and an attachment target object to which the display label is attached, wherein the display label has a slit serving as a separation and rupture portion for rupturing the display label upon separation of the display label from the attachment target object, the display label is divided by the slit in such a manner that the slit is continuously formed from a predetermined position to a different position on an outer peripheral edge of the display label, and the attachment target object had a groove corresponding to the slit, the groove being formed at a position where the slit is formed in a region where the display label is attached.

8. The display label attachment structure according to claim 7, wherein the display label has a hologram formation region where a hologram is formed, the hologram formation region being located on at least part of a label display surface, and the hologram formation region is divided by the slit.

9. The display label attachment structure according to claim 7, wherein a portion of the adhesive layer extends into the groove in the attachment target object.

10. A display label attachment structure comprising a display label having a back side on which an adhesive layer is formed, and an attachment target object to which the display label is attached, wherein the display label has a slit serving as a separation and rupture portion for rupturing the display label upon separation of the display label from the attachment target object, the display label is divided by the slit in such a manner that the slit is continuously formed from a predetermined position to a different position on an outer peripheral edge of the display label, and the attachment target object has a groove following the slit, the groove being formed in a region where the display label is not attached.

11. The display label attachment structure according to claim 10, wherein the attachment target object further has the groove corresponding to the slit, so that a portion of the groove is formed at a position where the slit is formed in a region where the display label is attached.

* * * * *